US005160062A

United States Patent [19]

Strawder

[11] Patent Number: 5,160,062

[45] Date of Patent: Nov. 3, 1992

[54] BAG SUPPORT FOR RECEPTACLES

[76] Inventor: Glenn G. Strawder, 9200 Edwards Way #1116, Adelphi, Md. 20783

[21] Appl. No.: 780,995

[22] Filed: Oct. 23, 1991

Related U.S. Application Data

[63] Continuation-in-part of Ser. No. 468,157, Jan. 22, 1990, Pat. No. 5,085,342, which is a continuation-in-part of Ser. No. 307,912, Feb. 9, 1989, Pat. No. 4,905,853.

[51] Int. Cl.[5] ..... B65D 90/04

[52] U.S. Cl. ..... 220/404; 220/909; 248/100

[58] Field of Search ..... 220/404, 908, 909; 248/95, 99, 100, 101

[56] References Cited

U.S. PATENT DOCUMENTS

| | | | |
|---|---|---|---|
| 4,834,253 | 5/1989 | Crine | 220/909 X |
| 4,834,262 | 5/1989 | Reed | 220/404 |
| 4,867,328 | 9/1989 | McCarthy | 220/909 X |
| 4,874,111 | 10/1989 | Heller | 220/404 |

*Primary Examiner*—Allan N. Shoap
*Assistant Examiner*—Stephen Cronin

[57] ABSTRACT

A receptacle is provided that has a multiplicity of projections that may be positioned at any of many locations along the upper end of the receptacle. Plastic bags for receiving trash are held by the projections. In view of the fact that the projections are movable to any desired location, one large bag or several small plastic bags can be selectively held by the projections in the receptacle. By selecting the locations of the projections the receptacle may be arranged to have one or more bags of different sizes that will fit the needs of the user of the receptacle. The projections may be placed in their desired positions in either of two ways. One way is to have a series of cavities around the top of the receptacle. The projections can be selectively placed in the various cavities to hold the desired number and sizes of bags. Another way is to have a continuous groove around the top of the receptacle to allow the projections to be positioned in any desired arrangement.

14 Claims, 1 Drawing Sheet

BAG SUPPORT FOR RECEPTACLES

RELATED APPLICATIONS

This application is a continuation-in-part of my prior copending application Ser. No. 07/468,157, filed Jan. 22, 1990, now U.S. Pat. No. 5,085,342, granted Feb. 4, 1992. The aforesaid copending application was a continuation-in-part of my application Ser. No. 07/307,912, filed Feb. 9, 1989, now U.S. Pat. No. 4,905,912, granted Mar. 6, 1990.

BACKGROUND OF THE INVENTION

The prior art teaches receptacles with projections extending from the open end for holding bags. The following two patents are examples:

McCarthy U.S.. Pat. No. 4,867,328 teaches a sectionized receptacle comprising a receptacle with either a round or rectangular horizontal cross section for positioning a plurality of bags of flexible material and projections of which one or more are used to support and hold the upper open end of the bags. McCarthy teaches his projections as being adjacent the upper open end of the receptacle and that they extend vertically away from the receptacle.

Preston U.S. Pat. No. 4,735,340 teaches a trash bag bracket for use on trash receptacles comprising a group of two brackets which are attached to the upper open end of a receptacle and extend vertically upward and away from the open end for positioning and holding a bag of flexible material.

SUMMARY OF THE INVENTION

This invention involves a receptacle having pins or projections extending from its upper surface for holding one or more flexible bags. The projections are, however, movable to different selected positions along the top of the receptacle. This allows the receptacle to receive one or more bags of different sizes. For example, the projections may be positioned to receive one plastic bag of the same size as the receptacle. Alternatively, the projections may be positioned to receive one bag which is say three-fourths the size of the receptacle and another bag which is one fourth the size of the receptacle.

The aforesaid arrangement is particularly useful in connection with trash cans that receive trash for recycling. In that situation it may be desirable to separate several different forms of trash. Thus, the user of the trash can may desire to have separate trash bags for (a) paper, (b) glass and (c) metal. The needs of the user of the trash may vary. For example, when the trash can is first used the volume of paper may greatly exceed the volume of glass and/or metal. With the passage of time the percentages of the different forms of trash may vary. Moreover, it is possible that the volume of paper may become so large that one entire receptacle is needed for paper and another receptacle would have one large bag for glass and a second bag for metal. With my invention the versatility of the trash can is greatly increased.

I will describe two forms of the invention as follows:

The first form of the invention may involve a rectangular receptacle having a groove around its upper end. Projections are mounted in the groove in a manner permitting the projections to be positioned to receive any number of bags including bags of different sizes.

The second form of the invention has a multiplicity of cavities along the upper end of the receptacle. The projections have a base portion which permits them to plug-in to any of the cavities. Thus, the projections can be positioned to support either one bag coextensive with the receptacle, or a number of bags of one or more sizes respectively.

DETAILED DESCRIPTION OF THE INVENTION

Figure 1:
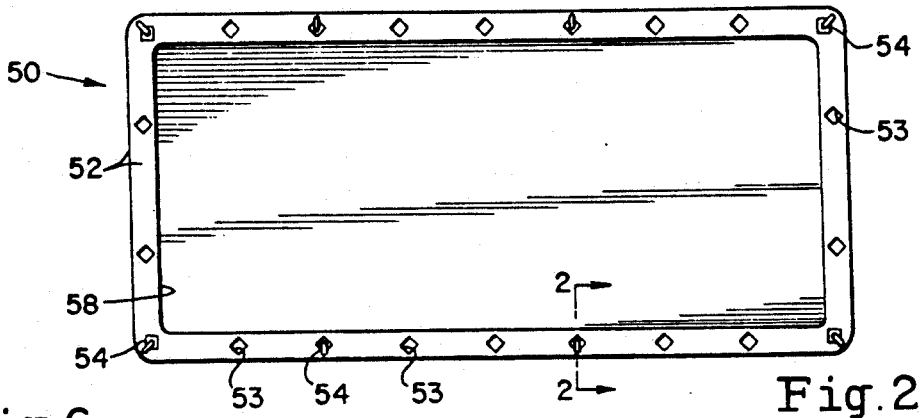
FIG. 1 is a top view of a receptacle embodying the invention.

In FIG. 1, the receptacle 50, composed of either metal or plastic, has an upper rim 52 indented to form a multiplicity of cavities 53. Some of these cavities are shown as having projections 54 in them. A typical such projection 56 (FIG. 2) has a base 57 which fits snugly in each one of the multiplicity of cavities 53. The cavities 53 are closely spaced relative to each other along the upper surface of the entire rim 52 to permit projections to be so placed as to enable any number of bags, large or small, to be held in the receptacle 50. The rim 52 is supported by the side wall 58 of the receptacle 50.

Figure 6:
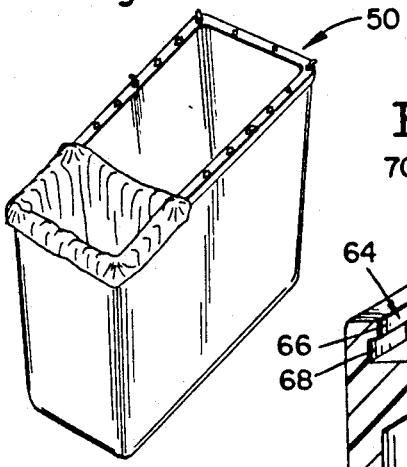
FIG. 6 is a perspective view of a receptacle according to the teachings of FIG. 1, showing one bag.

As shown in FIG. 6 the projections 56 are positioned to allow a single plastic flexible bag to be placed at one end of the receptacle 50.

Figure 4:
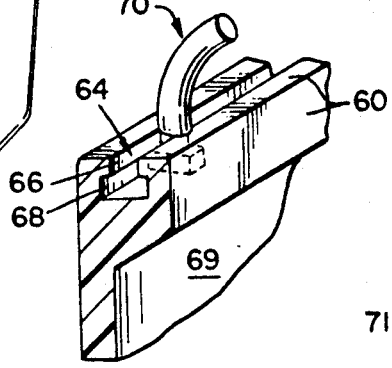
FIG. 4 is a sectional view taken along line 4—4 of FIG. 3.
Figure 5:
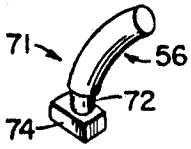
FIG. 5 is a perspective view of a slidable projection designed for use with the receptacle of FIG. 3.
Figure 3:
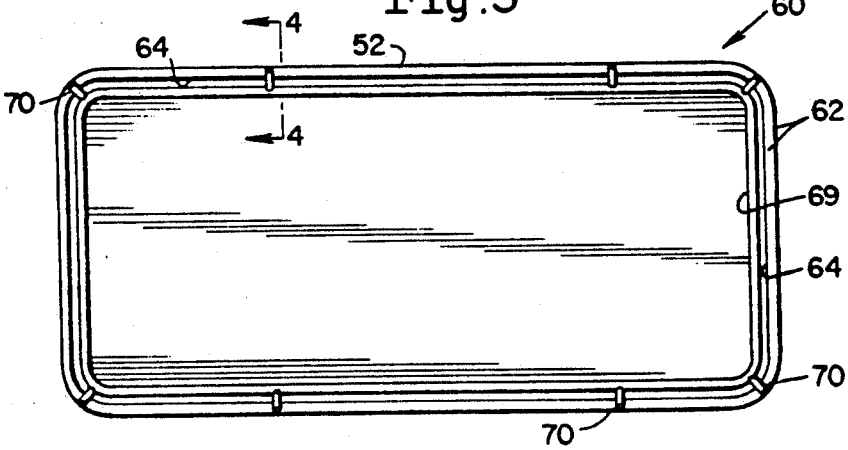
FIG. 3 is a top view of a modified form of the invention.

The modified form of FIGS. 3, 4 and 5 permits the user of the receptacle 60 to achieve the results described above. The rim 62 has a groove or cavity 64 located in upper end 52 of the receptacle 60. The groove or cavity 64 is shown in detail in FIG. 4 where the upper end of the cavity 64 is bounded by the overhanging portion 66 of the receptacle. The lower portion of the cavity 64 is bounded by the overhanging portion 66 of the receptacle. The lower portion of the cavity 64 is bounded by wall 68 and is bigger than the upper end of the cavity.

The base 74 of the projection 71 mates with the lower portion of cavity 64 and the rod portion 72 has a diameter slightly less than the width of the groove at the upper end of the cavity 64. In FIG. 3 the various projections 70 (a typical one of which is shown in FIG. 5) can be positioned at any location around the groove 64 so as to permit the plastic bags to be positioned in any desired arrangement as explained above.

Figure 2:
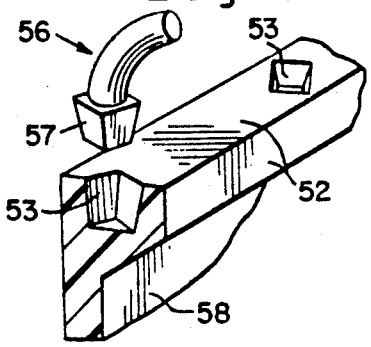
FIG. 2 is a sectional view taken along line 2—2 of FIG. 1.

The projection 56 (FIG. 5) is curved outwardly, the same as in FIG. 2. The projections 56 may be tapered to a point so that they may perforate the bags. However, actual perforation of the bags is unnecessary. If the upper ends of the bags are draped over the blunt projections (FIGS. 2 and 5) they may be held in place. Each of the cavities 53 and 64 have a base which is the lowermost horizontal wall that bounds the cavity.

I claim to have invented:

1. A receptacle having an upper end, said upper end comprising means defining at least one cavity for enabling a multiplicity of projections to be selectively placed in any of a multiplicity of positions at said upper end, said at least one cavity having a substantially closed base, said means, receiving at least two of said projections, for supporting bags in said receptacle, each of said projections, that are included in said means for supporting bags, having a base that mates with said at least one cavity to thereby support the projection.

2. A receptacle as defined in claim 1 in which said first-named means defines a multiplicity of cavities positioned in spaced relation to each other around said upper end.

3. A receptacle as defined in claim 2 in which each of the multiplicity of projections has a base that will mate with any of said cavities, each said base making a snug fit in each of said cavities to thereby hold the projection in its desired position.

4. A receptacle as defined in claim 3 in which said projection extend upwardly and outwardly from said upper end.

5. A receptacle as defined in claim 4 in which said projections are curved.

6. A receptacle having an upper end, said upper end comprising means defining at least one cavity for enabling a multiplicity of projections to be selectively placed in any of a multiplicity of positions at said upper end, said means including means for supporting bags in said receptacle, said first-named means defining said cavity in the form of a single groove extending around said upper end.

7. A receptacle as defined in claim 6 in which said projections extend upwardly and outwardly from said upper end.

8. A receptacle as defined in claim 7 in which said projections are curved.

9. A receptacle as defined in claim 6 in which there are a multiplicity of projections which are slidable in said groove to their desired positions.

10. A receptacle as defined in claim 7 in which each of said projections have a base that mates with said groove.

11. A receptacle as defined in claim 10 in which said groove has an enlarged portion for receiving said base and a portion which is restricted to prevent said base from passing through the same.

12. A receptacle having an upper end, said upper end comprising means defining at least one cavity for enabling a multiplicity of projections to be selectively placed in any of a multiplicity of positions at said upper end, said at least one cavity comprising an elongated cavity for guiding at least one of said projections and permitting a projection that is in said elongated cavity to be moved along the elongated cavity, said means, including at least some of said projections, comprising means for supporting bags in said receptacle.

13. A receptacle as defined in claim 12 in which said projections extend upwardly and outwardly from said upper end.

14. A receptacle as defined in claim 12 in which there are a multiplicity of projections which are slidable in said elongated cavity to their desired positions.

* * * * *